US008666294B2

(12) United States Patent
Minegishi et al.

(10) Patent No.: US 8,666,294 B2
(45) Date of Patent: Mar. 4, 2014

(54) CARRIER REMOVING DEVICE AND IMAGE FORMING APPARATUS

(75) Inventors: Natsuko Minegishi, Hachioji (JP); Naoki Tajima, Sagamihara (JP); Seiko Itagaki, Hachioji (JP); Hiroyuki Saito, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 300 days.

(21) Appl. No.: 12/904,014

(22) Filed: Oct. 13, 2010

(65) Prior Publication Data

US 2011/0097115 A1 Apr. 28, 2011

(30) Foreign Application Priority Data

Oct. 23, 2009 (JP) ..... 2009-244195

(51) Int. Cl.
*G03G 15/00* (2006.01)

(52) U.S. Cl.
USPC ..... 399/264; 399/100; 399/171; 399/348

(58) Field of Classification Search
USPC ..... 399/88–90, 93, 98–100, 168, 170–173, 399/249, 264
See application file for complete search history.

(56) References Cited

U.S. PATENT DOCUMENTS

| | | | | |
|---|---|---|---|---|
| 3,484,163 | A * | 12/1969 | Eichorn et al. | 399/367 |
| 5,799,233 | A * | 8/1998 | Ishii et al. | 399/175 |
| 2003/0096186 | A1 * | 5/2003 | Viturro et al. | 430/117 |
| 2008/0247782 | A1 * | 10/2008 | Sato et al. | 399/171 |
| 2008/0253806 | A1 * | 10/2008 | Yoshino et al. | 399/171 |
| 2009/0074463 | A1 * | 3/2009 | Nishio et al. | 399/170 |
| 2010/0329702 | A1 * | 12/2010 | DiRubio et al. | 399/27 |

FOREIGN PATENT DOCUMENTS

| | | |
|---|---|---|
| JP | 61-077869 | 4/1986 |
| JP | 61-200561 | 9/1986 |
| JP | 62-267780 | 11/1987 |
| JP | 10-240016 | 9/1998 |

OTHER PUBLICATIONS

Notice of Reasons for Refusal mailed by JPO on Jun. 11, 2013, in connection with Appl. No. 2009-244195, 2 pgs.
Translation of the Notice of Reasons for Refusal mailed by JPO on Jun. 11, 2013, in connection with Appl. No. 2009-244195, 3 pgs.

* cited by examiner

*Primary Examiner* — Walter L Lindsay, Jr.
*Assistant Examiner* — Jessica L Eley
(74) *Attorney, Agent, or Firm* — Squire Sanders (US) LLP

(57) ABSTRACT

A carrier removing apparatus, including: an electrode, having a plurality of openings through which a carrier passes, disposed to oppose an image carrier, and a power source to apply a voltage onto the electrode so as to separate the carrier on the image carrier from the image carrier, wherein the electrode has a surface along a surface of the image carrier.

19 Claims, 9 Drawing Sheets

CARRIER REMOVING DEVICE AND IMAGE FORMING APPARATUS

This application is based on Japanese Patent Application No. 2009-244195 filed on Oct. 23, 2009, in Japanese Patent Office, the entire content of which is hereby incorporated by reference.

TECHNICAL FIELD

The present invention relates to an image forming apparatus to form an image via an electrophotographic process, and in particular to a carrier removing apparatus to remove a carrier from an image carrier of the image forming apparatus.

In the electrophotographic process, an electrostatic latent image found on the image carrier such as a photoconductive member is developed by toner, and the toner image formed by developing is transferred onto a recording member, whereby an image is formed.

As developing methods to develop the electrostatic latent image, there are two methods such as two-component developing method where a two-component developer having toner and carrier is used for developing and a one-component developing method where the one-component developer having toner without carrier is used for developing.

The two-component developing method superior in aspects such as graduation expression and resolution is widely used.

In the two-component developing method, there is a problem that the carrier adheres on the image carrier. The carrier adhered on the image carrier causes deterioration of image quality by deteriorating a cleaning performance of a cleaning device. When adhesion of the carrier occurs, a hump in a shape of a crater is formed on a surface of the image carrier in the transfer section to transfer the toner image, since the carrier is pressed onto the image carrier. The aforesaid hump damages the cleaning blade configuring the cleaning device when the cleaning device passes on the hump and deteriorates the cleaning performance. Namely, after the cleaning blade passes on the toner humps, the toner remains on the image carrier as streaks which cause uneven streaks in the image formed in a subsequent image forming cycle.

As a countermeasure for the problem of carrier adhesion, in a developing process, there are a method to prevent the image carrier from adhering of the carrier and a method to remove the carrier adhered on the image carrier.

Since the former method is difficult to apply to a high speed image forming, the later method is prospective.

In the Patent Document 1: Unexamined Japanese Patent Application Publication No. S61-200561, there is disclosed a carrier recovering apparatus in which the carrier is removed from the photoconductive member by applying a voltage, created by superimposing a direct current to an alternative current, to an electrode in a shape of a knife edge or in a shape of a cylinder disposed to oppose a photoconductive member.

Patent Document 1: Unexamined Japanese Patent Application Publication No. S61-200561

In the carrier recovering apparatus of the Patent Document 1, the strongest electric field to remove the carrier from the photoconductive member is created by a line formed at a tip of a knife edge or by a linear section closest to the photoconductive member in a cylindrical surface, wherein the electric field is weaken drastically in an area off the line. A carrier removing performance is high in a very small area, however the carrier removing performance is lowered drastically in another area, thus the sufficient carrier removing performance cannot be obtained as a whole.

In Patent Document 1, the carrier removed from the photoconductive substance adheres on the electrode and the carrier adhered on the electrode is accumulated on a surface of the electrode. Thus, the carrier accumulated adheres on the photoconductive member again. In particular, in case the electric field is increased in the strength in order to enhance removing performance in Patent Document 1, since the carrier removing area is narrow, the strong electric field has to be formed and by the electric field having an excessive strength, the carrier adheres again onto the photoconductive member.

As above, in the carrier recovery apparatus of Pant Document 1, it is difficult that the carrier is removed from the photoconductive member sufficiently. Also, the performance of the carrier recovery apparatus is not stable.

SUMMARY

The present invention has one aspect to solve the problems of the conventional carrier recovering apparatus to remove the carrier from the image carrier and an object of the present invention is to provide a carrier removing apparatus having a sufficient carrier removing performance to enable stable operation, and an image forming apparatus.

The above objects are achieved by the following structures.

Structure 1. A carrier removing apparatus, including: an electrode disposed to oppose an image carrier having a plurality of openings through which a carrier passes, and a power source to apply a voltage onto the electrode so as to separate the carrier on the image carrier from the image carrier.

Structure 2. An image forming apparatus, having: an image carrier to carry a toner image; a developing device to develop a toner image on the image carrier using a two-component developer including carrier and toner, and the carrier removing apparatus of claim 1 disposed at a downstream side of the developing device in a moving direction of the image carrier, wherein the carrier removing apparatus is provided with an electrode disposed to oppose an image carrier having a plurality of openings through which a carrier passes, and a power source to apply a voltage onto the electrode so as to separate the carrier on the image carrier from the image carrier.

DETAILED DESCRIPTION OF PREFERRED EMBODIMENTS

The present invention will be described on the basis of embodiments without the present invention being limited thereto.

Figure 1:
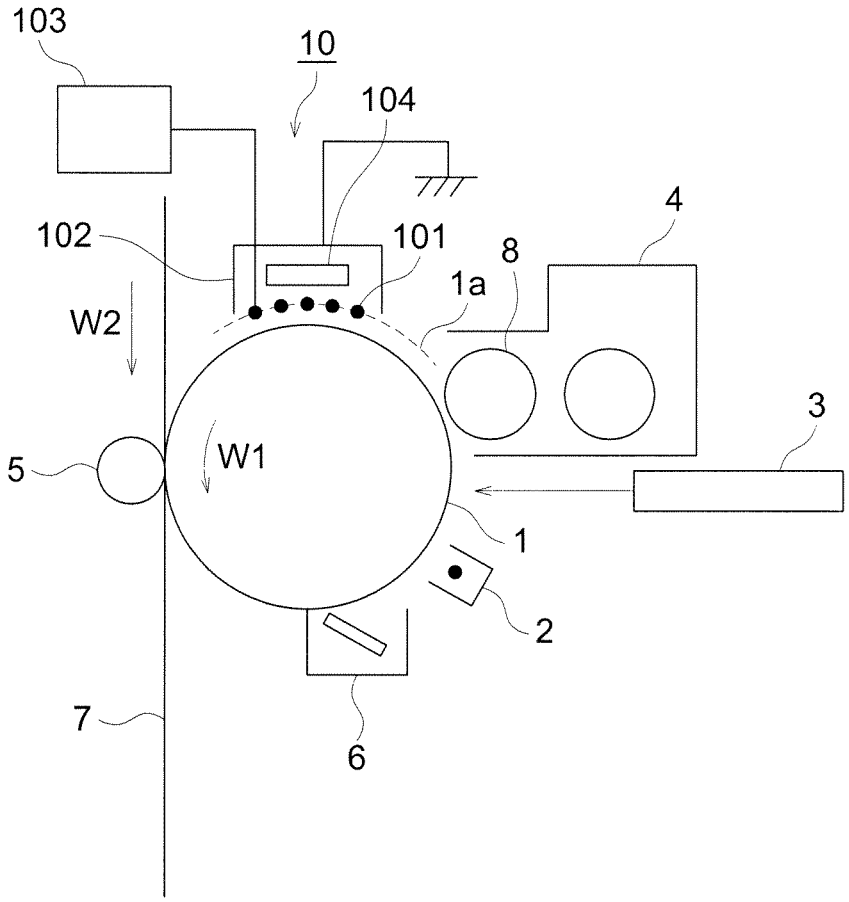
FIG. 1 shows an example of an image forming apparatus related to an embodiment of the present invention.

FIG. 1 shows an example of an image forming apparatus related to an embodiment of the present invention. In a periphery of a photoconductive member in a shape of a drum representing an image carrier, a charging device 2, an exposing device 3, a developing device 4, a transfer device 5 and a cleaning device 6 are disposed. The developing device 4 has a developing roller 8. The transfer device 5 transfers a toner image on the photoconductive member 1 to an intermediate transfer member 7. The exposing device 3 having a light source to emit light based on image data scans and exposes the photoconductive member 1. The developing device 4 using a two-component developer having toner and carrier develops an electrostatic latent image through a two-component developing method to form a toner image.

The photoconductive member 1 rotates in a direction W1 shown by an arrow and the intermediate transfer member 7 moves in a downward direction W2 shown by an arrow so as to perform image forming.

The electrostatic latent image is formed on the photoconductive member 1 by charging of the charging device 2 and by image wise exposure of the exposing device 3. The electrostatic latent image having been formed is developed via the developing roller 8 of the developing device 4 to form a toner image on the photoconductive member 1. The toner image on the photoconductive member 1 is transferred via the transfer device 5 onto the intermediate transfer member 7.

The toner image on the intermediate transfer member 7 is transferred onto a recording member through an unillustrated transfer device 5, and the toner image on the recording member is fixed via an illustrated fixing member.

The image forming apparatus is provided with a carrier removing apparatus 10 to remove carrier on the photoconductive member 1. The carrier removing apparatus 10 is disposed at a downstream side of the developing device 4 and at an upstream side of the transfer device 5 in a moving direction of the surface of the photoconductive member 1.

Figure 2:
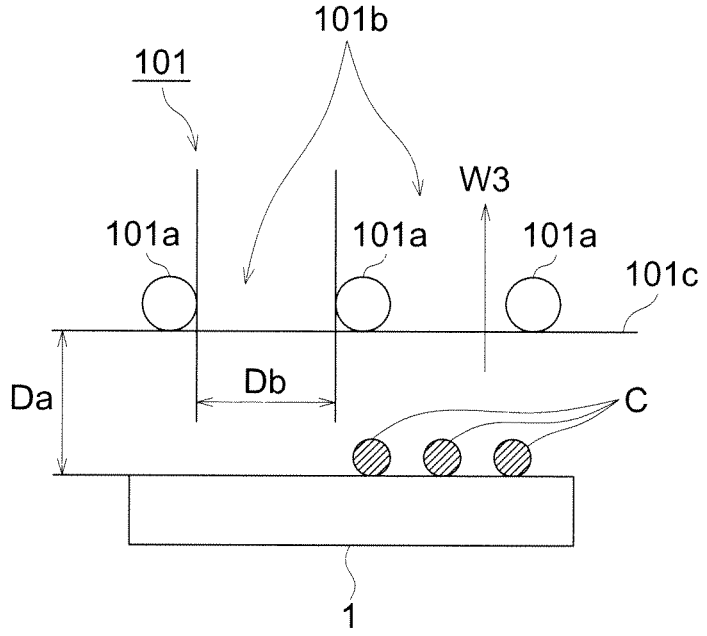
FIG. 2 is a diagram showing a positional relation between an image carrier and an electrode.

The carrier removing apparatus 10 related to the embodiment of the present invention will be described with reference to FIG. 1 and FIG. 2. FIG. 2 is a diagram showing a positional relation between the image carrier and the electrode.

The carrier removing apparatus 10 is provided with an electrode 101, a housing 102, a power source 103, and a magnet 104. The electrode 101 configured with wires or a mesh is disposed to have a distance Da with respect to the surface of the photoconductive member 10 as FIG. 2 shows. The electrode 101 has a number of openings so that the carrier goes through therein.

In FIG. 2, a symbol 101*a* denotes the wire or a grid of the mesh, and a symbol 101*b* denotes a grid interval representing a space between the grid 101*a*. The grid interval 101*b* forms an opening of the electrode 101 through which a carrier C goes through. A length of the grid interval 101*b* is called as an electrode opening diameter Db as well.

A bias voltage is applied to the electrode 101 via a power source 103 so as to generate an electric force to attract the carrier C. The bias voltage is configured with a direct current voltage or a superimposed voltage where an alternate current and a direct current are superimposed. The electric field is created by the bias voltage between the electrode 101 and the photoconductive member 1 in which a drum substrate is grounded. In the embodiment using negative charged toner and positive charged carrier, the power source 103 applies a negative voltage current or a negative superimposed voltage, in which a negative voltage current is super imposed by an alternate current, onto the electrode 101 so as to attract and remove a positively charged carrier C from the photoconductive member 1. The voltage, in which the direct current is superimposed by the alternate current, creates an electric field to vibrate the carrier C so that the carrier C can be removed from the photoconductive member 1 readily, thus the carrier C is preferably removed form the photoconductive member. A housing 102 configured with a conductive plate member is maintained at the same voltage as that of the electrode 101.

The distance Da between the surface of the photoconductive member 1 and a surface (a surface facing the photoconductive member 1) of the electrode 101 is preferred to be 0.5 mm to 1.5 mm.

The electrode opening diameter Db is set at a size so that the carrier C passes through the opening. If the electrode opening diameter Db is too large, the electric field created by the electrode 101 and the photoconductive member 1 is weakened and the carrier C may remain on the photoconductive member 1.

The electrode opening diameter Db is preferred to be not less than two times the volume average particle diameter and not more than the distance Da.

As the carrier, one having the volume average particle diameter of 10 to 60 μm is used. Here, the volume average particle diameter is an average particle diameter based on the volume measured by a laser diffraction method particle size analyzer "HELOS"™ of Shimpatech AG provided with a wet dispersion unit. The size of the grid of the wires or the mesh is preferred to be not more than three times of the volume average particle diameter of the carrier.

Further, a length of the electrode 101 along the moving direction of the photoconductive member 1, namely a width of the electrode 101 is prefer to be as large as possible in order to enhance the removing function of the carrier and determined in a relation with other components configuring the image forming apparatus.

The electrode 101 is provided with a surface along the surface of the photoconductive member 1. Though the wire and the mesh configuring the electrode 101 has an irregularity on the surface microscopically, the surface of the electrode 101 is represented by a tangential line 101*c* connecting apexes of the grids 101*a* as FIG. 2 shows. The electrode 101 having the surface along the surface of the photoconductive member 1 in a drum shape is preferred to be configured by disposing the grid configuring the electrode 101 on a circle 1*a* which is concentric with the photoconductive member as FIG. 1 shows.

Since the electrode 101 has a surface along the surface of the photoconductive member 1, the distance Da between the electrode 101 and the photoconductive member 1 is even across the total area thereof, thus the electrode 101 forms an even electric field across the entire area. Whereby, the carrier C is separated from the photoconductive member 1 by the electric field.

The carrier C is separated from the photoconductive member 1 by the electric field formed by the electrode 101 and passes through the grid interval 101*b* representing the electrode opening. The magnet 104 is disposed behind the electrode 101 as seen from a photoconductive member 1 side, and the carrier C went through the grid interval 101*b* is magnetically attracted and adhered by the magnet 104 to be removed.

While the electrode 101 is preferred to have the shape along the surface of the photoelectric member 1, the straight line 101*c* in FIG. 2 does not have to be precisely parallel to the surface of the photoconductive member 1. A sufficient carrier removing effect is obtained even if an electrode having a flat plate shape is opposed with respect to the photoconductive member in a drum shape.

Figure 3:
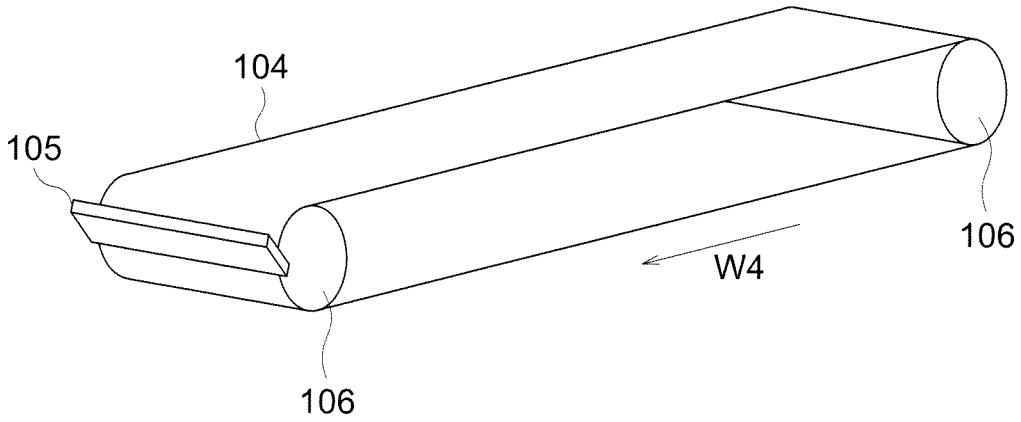
FIG. 3 is a diagram showing a mechanism to remove a carrier from a magnet 104.

FIG. 3 shows a mechanism to remove the carrier from the magnet 104.

The magnet 104, configured with a rubber magnet endless belt in which powder magnet is dispersed in rubber, is installed on two rollers 106.

The carrier is removed from the magnet 104 by scratching the carrier on the magnet 104 with a blade 105 after moving the magnet 104 in a width W4 direction shown by an arrow. Incidentally the width direction W4 is perpendicular to a moving direction W1 of the photoconductive member 1 in FIG. 1.

FIG. 4 shows examples of the wires or the mesh configuring the electrode.

Figure 4A:
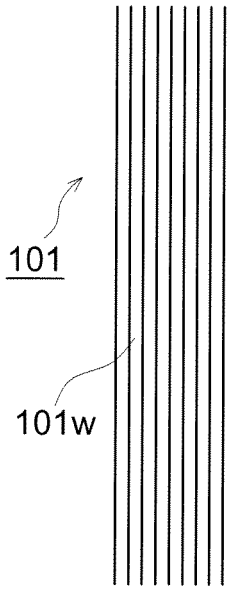
FIGS. 4*a*, 4*b*, 4*c* and 4*d* are diagrams showing exemplary wires or meshes.
Figure 4B:
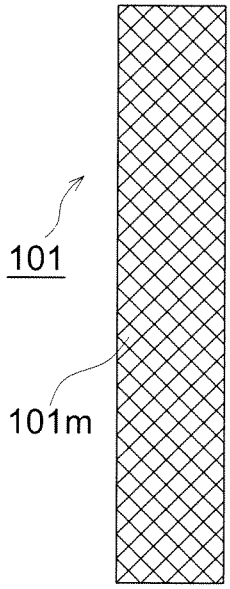
Figure 4C:
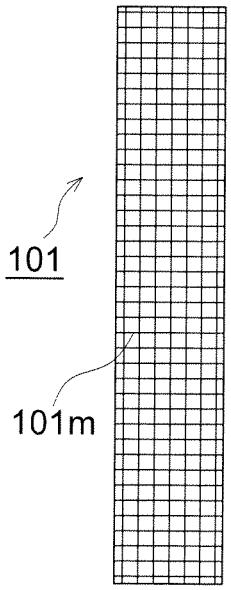
Figure 4D:
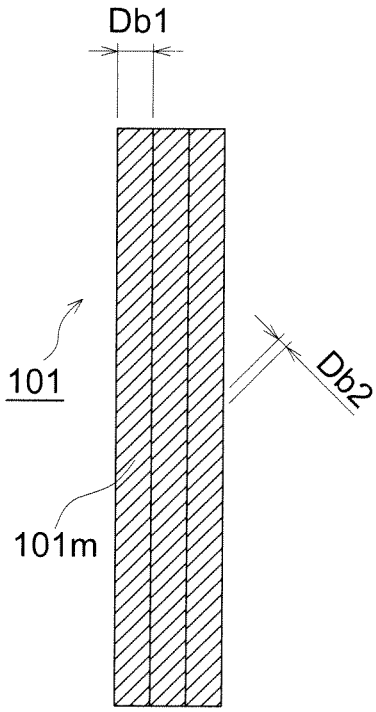

FIG. 4*a* is an example of the electrode 101 configured with a plurality of wires 101*w*. FIGS. 4*b* to 4*d* show examples of electrodes 101 configured with a mesh 101*m*. The mesh 101*m* of FIG. 4*b* is configured with a grid which is inclined at 45° angle with respect to the width direction W4. The mesh 101*m* of FIG. 4*d* is configured with a grid inclined at 0° angle and a grid inclined at 90° with respect to the width direction W4. In FIG. 4*d*, the electrode opening diameter Db2 representing gaps of the grid inclining with respect to the width direction W4 is configured smaller than the electrode opening diameter Db1 representing gaps of the grid inclining at 0° with respect to the width direction W4.

The mesh 101*m* of the electrode 101 shown by FIG. 4*b* and FIG. 4*d* has a grid inclining to the width direction W4. In case of FIG. 4*b* and FIG. 4*d*, the photoconductive member 1 receives an effect of the uniform electric field in the width direction W4 while moving in the direction W1 in FIG. 1. Thus an electric force to separate the carrier from the photoconductive member acts with respect to all the carriers on the photoconductive member 1 evenly and the photoconductive member 1 is cleaned evenly.

Figure 5A:
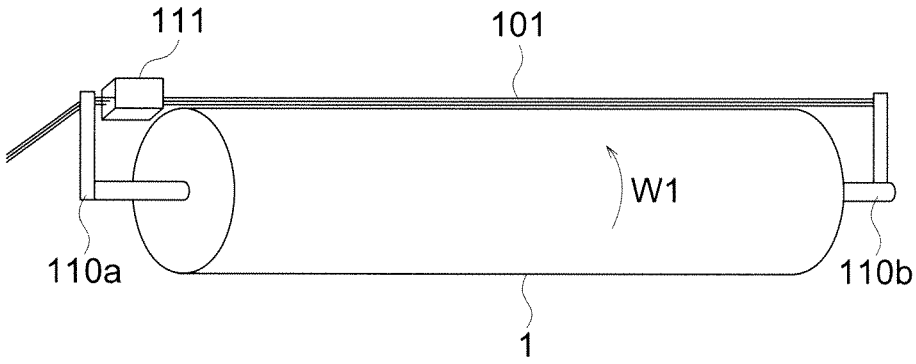
FIGS. 5*a* and 5*b* are diagrams showing exemplary wires or meshes.
Figure 5B:
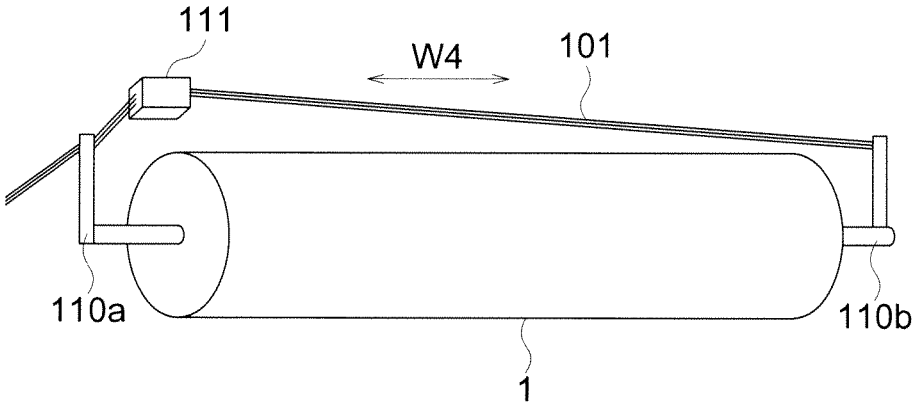
Figure 6:
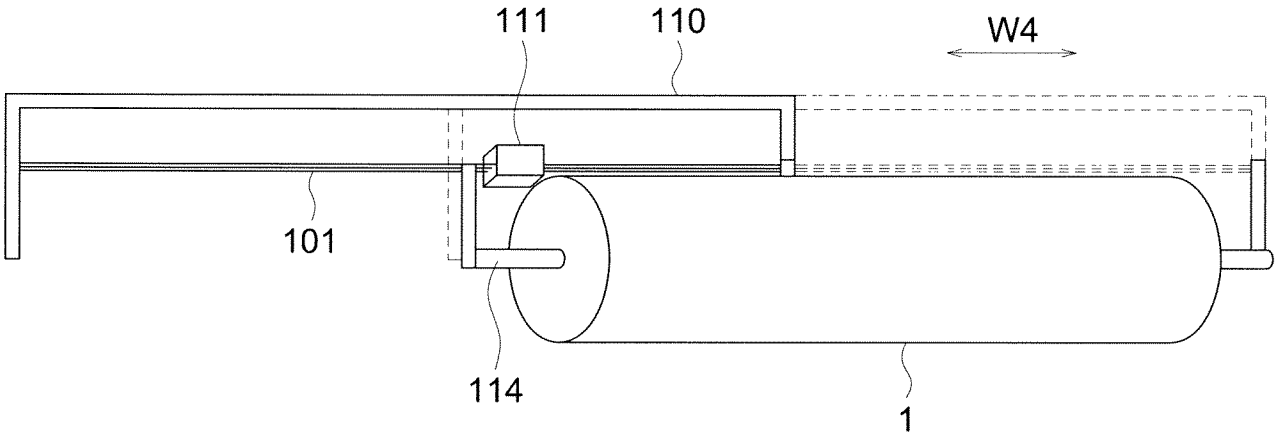
FIG. 6 is a diagram showing an exemplary wire or mesh.
Figure 7:
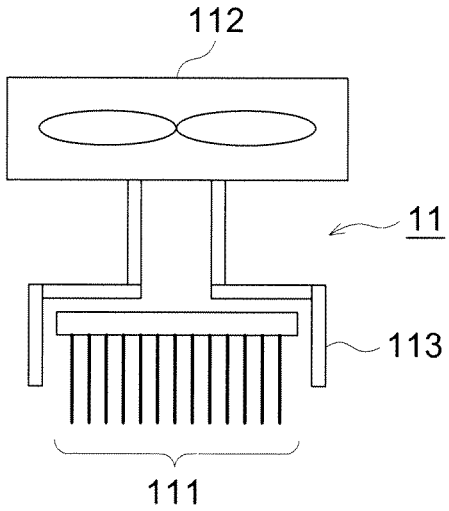
FIG. 7 is a diagram showing an exemplary wire or mesh.

FIGS. 5 to 7 show a cleaning device of the electrode 101.

In FIG. 5, the electrode 101 is hanged by support arms 110*a* and 110*b* provided at both ends of the photoconductive member 1. A numeral 11 denotes the cleaning device to clean the electrode 101. As FIG. 7 shows, the cleaning device 11 is configured with a brush 111, a suction device 112 having a fan and a housing 113. The brush 111 scrapes the toner adhering on the electrode 101 and the suction device 112 suctions to recover the scraped toner.

FIG. 5*a* shows a state of image forming where the electrode 101 removes the carrier from the photoconductive member 1 moving in the direction W1. FIG. 5*b* shows a state of cleaning the electrode 101. In FIG. 5*b*, the electrode 101 becomes slack between the support members 110*a* and 110*b* so as to widen the gap between the photoelectric member 1 and the electrode 101. The cleaning device 11 can move in the widened gap in the width direction W4.

By moving the cleaning device 11 in the width direction W4 in the state of FIG. 5*b*, the electrode 101 is cleaned.

Cleaning of the electrode 101 is performed periodically for each image forming of a predetermined number of sheets, each start of image forming or each time when a main switch of the image forming apparatus is turned on.

FIG. 6 shows another example of a cleaning mechanism for the electrode 101. In FIG. 6, the electrode 101 is hung by the support arm 110 which is movable in the width direction W4. The cleaning device 11 is supported by a fixed support arm 114.

At the time of image forming, the electrode 101 and support arm 110 are set at positions shown by broken lines and remove the carrier from the photoconductive member moving in the W1 direction. At the time of cleaning, the support arm 110 moves in the width direction W4, for example, to a position shown by a solid line. By the above movement, the cleaning device 11 and the electrode 101 move relatively and the electrode 101 is cleaned.

Figure 8:
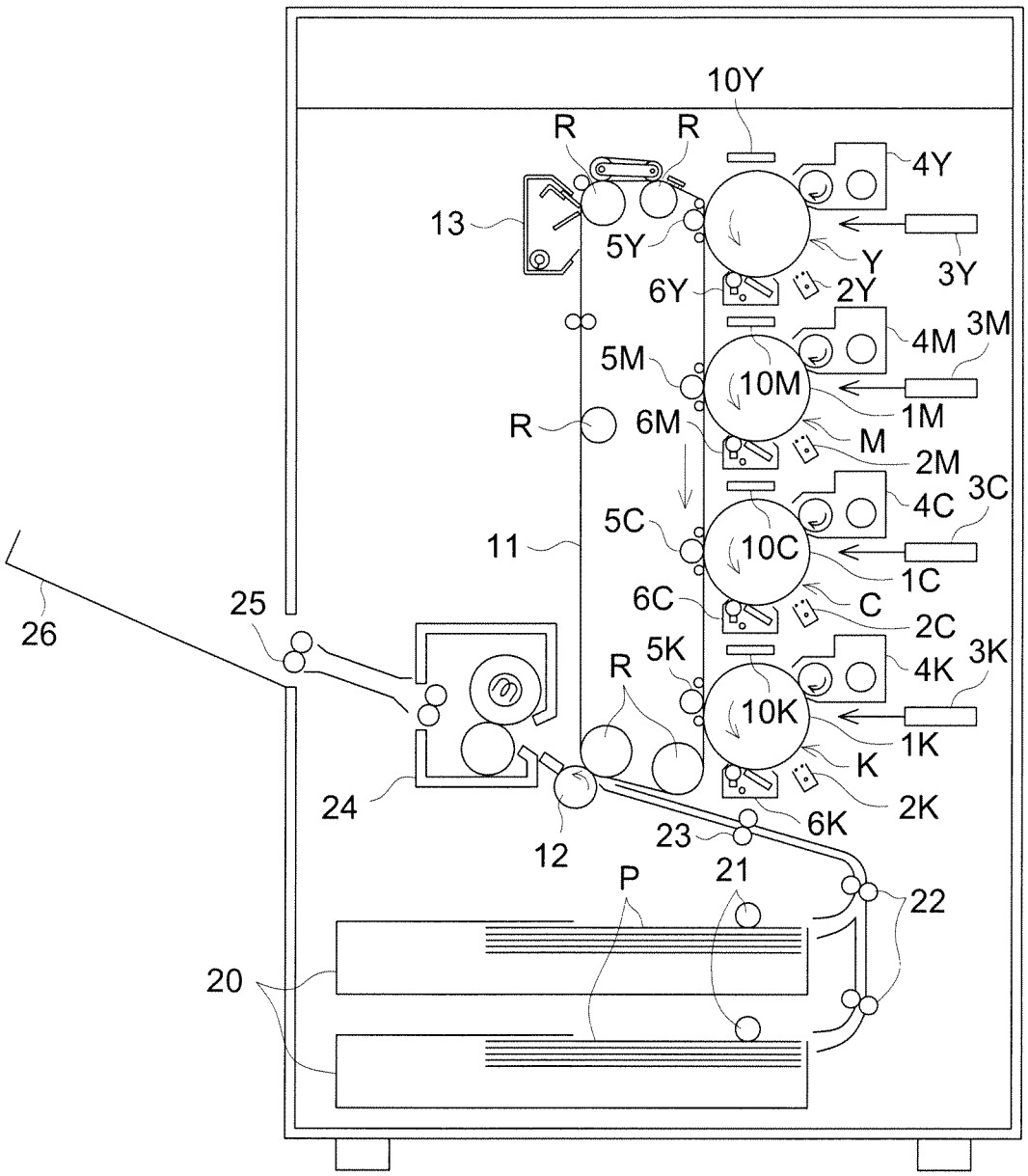
FIG. 8 is a diagram showing an entire configuration of a color image forming apparatus representing an image forming apparatus related to an embodiment of the present invention.

FIG. 8 shows an entire configuration of a color image forming apparatus representing an image forming apparatus related to an embodiment of the present invention. The color image forming apparatus is provided with an image forming section Y to form a yellow toner image, an image forming section M to form a magenta toner image, an image forming section C to form a cyan toner image and an image forming section K to form a black toner image.

The image forming section Y is provided with a photoconductive member 1Y, a charging device 2Y, an exposing device 3Y, a developing device 4Y, a primary transfer device 5Y, a cleaning device 6Y and a carrier removing device 10Y. The image forming section M is provided with a photoconductive member 1M, a charging device 2M, an exposing device 3M, a developing device 4M, a primary transfer device 5M, a cleaning device 6M and a carrier removing device 10M. The image forming section C is provided with a photoconductive member 1C, a charging device 2C, an exposing device 3C, a developing device 4C, a primary transfer device 5C, a cleaning device 6C and a carrier removing device 10C. The image forming section K is provided with a photoconductive member 1K, a charging device 2K, an exposing device 3K, a developing device 4K, a primary transfer device 5K, a cleaning device 6K and a carrier removing device 10K.

A numeral 7 denotes an intermediate transfer belt in a shape of an endless belt disposed to oppose the image forming sections Y, M, C and K and installed on a plurality of rollers R.

A recording member P stored in a sheet feeding tray 20 is fed one by one via a sheet feeding rollers 21 and conveyed to a transfer position via a plurality of conveyance rollers 22 and register rollers 23. A numeral 12 denotes a secondary transfer device to which a transfer bias is applied, a numeral 24 denotes a fixing device to fix the toner image by heat, a numeral 25 denotes sheet ejection rollers and a numeral 26 denotes a sheet ejection tray.

A yellow toner image formed in the image forming section Y is transformed onto the intermediate transfer member 7 via the primary transfer device 5Y, a magenta toner image formed in the image forming section M is transformed onto the intermediate transfer member 7 via the primary transfer device 5M, a cyan toner image formed in the image forming section C is transformed onto the intermediate transfer member 7 via the primary transfer device 5C, and a black toner image formed in the image forming section K is transformed onto the intermediate transfer member 7 via the primary transfer device 5K. The above toner images are overlapped on the intermediate transfer member 7 and a color toner image is formed.

The color toner image on the intermediate transfer member 7 is transferred onto the recording member P via the secondary transfer device 12 at the transfer position.

The color image on the recording member P is heated by the fixing device 24 to be fixed onto the recording member P. The recording member P having been subject to the fixing process is ejected onto the sheet ejection tray 26 via the sheet ejection rollers 25.

The intermediate transfer member 7 after transferring the color image is cleaned by the cleaning device 13.

Each image forming section has the carrier removing apparatus to remove the carrier from the photoconductive member. Namely, the image forming section Y has the carrier removing apparatus 10Y, the image forming section M has the carrier removing apparatus 10M, the image forming section C has the carrier removing apparatus 10C, and the image forming section K has the carrier removing apparatus 10K respectively.

The carrier removing apparatuses 10Y, 10M, 10C and 10K shown in FIGS. 1 to 3 posse the configurations and the function explained in the foregoing to remove the carrier from the photoconductive members 1Y, 1M, 1C and 1K.

Figure 9:
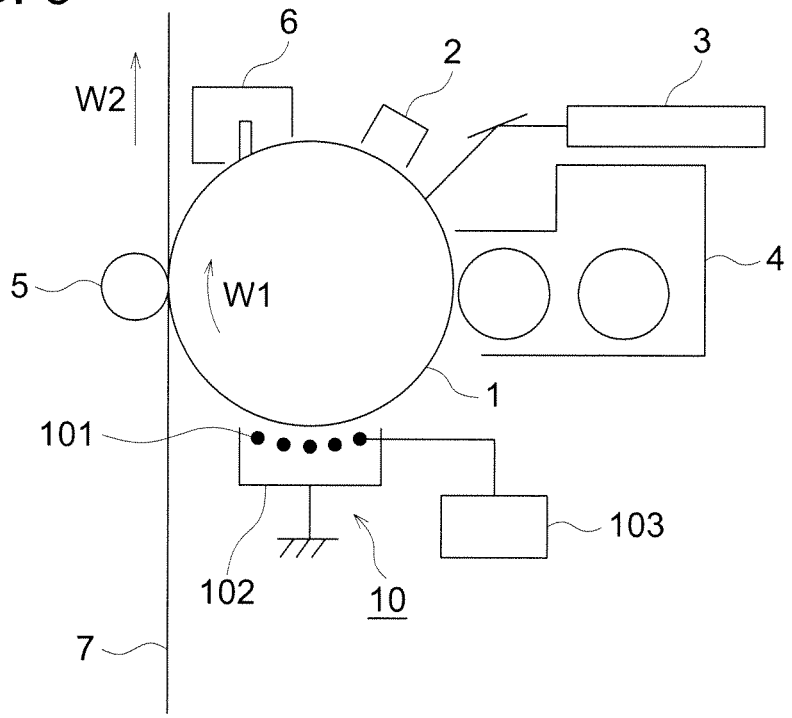
FIG. 9 is a diagram showing an exemplary image forming apparatus in which a carrier removing apparatus is disposed below a photoconductive member.

FIG. 9 shows an exemplary image forming apparatus in which the carrier removing device is disposed under the photoconductive member.

The same parts as the parts in the FIG. 1 are denoted by the same symbols.

In the present embodiment, the carrier removing apparatus 10 is disposed under the photoconductive member 1. In this arrangement, the carrier suctioned from the photoconductive member 1 by the electrode 101 passes through the electrode opening of the electrode 101 via an effect of the gravity and falls to a housing 102 representing a container to store the carrier to be stored. Therefore, the magnet 104 shown in FIG. 1 is not always necessary. Incidentally, by disposing the magnet 104 in FIG. 1 in the carrier removing apparatus shown by FIG. 9, the carrier can be removed more effectively and grime of the electrode which removes the carrier can be suppressed.

Embodiment

Common Conditions for Embodiments 1 and 2

<Conditions of the Electrode>

- An electrode configured with a number of the wires 101*w* shown in FIG. 4*a*
- Distance Da between the wire and the photoconductive member: 1.0 mm
- Electrode opening diameter Da: 1.0 mm
- Electrode width (length of the electrode in the width direction W4): 350 mm
- Number of the wire: 10 (installing range: 9 mm)
- Wire diameter: 60 μm
- Material: Tungsten
- Wire tensional force: 4 N
- Wire application voltage: DC −1000V
- AC amplitude: 2.5 kVpp
- Frequency: 5 kHz
- Duty: 30% (voltage application time in a direction to remove carrier: 70%)

<Conditions of the Photoconductive Member>

- Diameter of the photoconductive member: 60 mm
- Background section voltage of the photoconductive member: −600 V
- Solid exposing section voltage of the photoconductive member: −50 V <Other Conditions>

- Toner diameter: 6.5 μm (volume average particle diameter)
- Carrier diameter: 33 μm (volume average particle diameter)
- Toner density: 7% by weight
- Amount of developer in developing vessel: 1000 g
- Normal rotation developing
  - (The Normal rotation developing is that the surface of the photoconductive member 1 and the surface of the developing roller 8 rotate in the same direction at the position they come close.)

Conditions for the Embodiment 1

- The image forming apparatus shown by FIG. 1 was used.
- Material: Neodymium family rubber magnet
- Thickness: 2.0 mm
- Magnetic flux density: 150 mT
- Wire—Magnet Distance: 1 mm Conditions for the Embodiment 2

- The image forming apparatus shown by FIG. 9 was used.
- Other conditions are the same as that of the embodiment 1.

Conditions for a Comparison Example

A carrier recovering device shown in FIG. 2 of the Patent Document 1 was used. Namely, the carrier recovering device having a fixed magnet role and a rotation sleeve wherein a bias voltage in which a direct current voltage and an alternate current voltage are superimposed is applied to the rotation sleeve under the conditions below was used.

- Rotation sleeve—Photoconductive member distance: 0.3 mm
- Longitudinal length: 350 mm
- Rotation sleeve outer diameter: 18$^{\phi}$
- Main pole magnet flux density of magnet role: 130 mT
- Application voltage: DC −800 V
- AC amplitude: 0.8 kVpp
- Frequency: 5 kHz
- Duty: 30% (voltage application time in a direction to remove carrier: 70%)

<Conditions of the Photoconductive Member>

- Diameter of the photoconductive member: 60 mm
- Background section voltage of the photoconductive member V0: −600 V
- Solid exposing section voltage of the photoconductive member Vi: −50 V <Other Conditions>

- Toner diameter: 6.5 μm (volume average particle diameter)
- Carrier diameter: 33 μm (volume average particle diameter)
- Toner density: 7% by weight
- Amount of developer in the developing vessel: 1000 g
- Normal rotation developing (Evaluation)

By changing a linear speed, the number of the carriers adhering on the photoconductive member with respect to a fog margin after removing adhering toner is evaluated.

In the present embodiments and in the comparison example, $$\text{(Fog merging)} = |\text{(Background section voltage of the photoconductive member)} - \text{(Developing DC bias voltage)}|$$

It is preferable if the number of carriers adhering is not more than five in an area of 18×297 mm on the photoconductive member.

Results of the evaluation will be shown in the Table 1.

Incidentally, while the fog margin is usually set 100 to 150V, it can be set more than the above value in accordance with a condition of the developer. The condition of the developer where the fog margin has to be set more than 150 V, is a condition where a charging amount of toner is reduced due to deterioration of the developer or a high temperature and high humidity environment, or a condition where insufficient charged toner is increased due to high coverage printing after low coverage printing. When this occurs, since fog of toner on the background section is likely to occur, a large fog margin has to be set.

TABLE 1

| Linear Speed (mm/s) | Fog margin (V) | Number of carriers adhering before recovery | Number of carrier adhering after recovery: Embodiment 2 | Embodiment 1 | Comparison Example |
|---|---|---|---|---|---|
| 300 | 100 | 0 to 5 | 0 | 0 | 0 |
| | 150 | 5 to 15 | 0 | 0 | 2 |
| | 300 | 280 to 320 | 1 | 1 | 10 |
| 600 | 100 | 0 to 5 | 0 | 0 | 3 |
| | 150 | 40 to 60 | 1 | 1 | 4 |
| | 300 | 800 to 1000 | 2 | 1 | 50 |
| 900 | 100 | 80 to 120 | 1 | 1 | 5 |
| | 150 | 800 to 1000 | 4 | 2 | 80 |
| | 300 | More than 1000 | 5 | 3 | 500 |

The following is revealed from the Table 1.

(1) In the comparison example, since the carrier removing area is narrow, the number of the carriers adhering became a faulty level as the linear speed increases when the fog margin is large.

(2) In the embodiments 1 and 2, the number of the carriers adhering was always in a good level.

(3) At a high linear speed, when the fog margin is 300V, the embodiment 1 using the magnet having relatively high magnetic force had a higher efficiency of removing the carrier than that of the embodiment 2.

Figure 10:
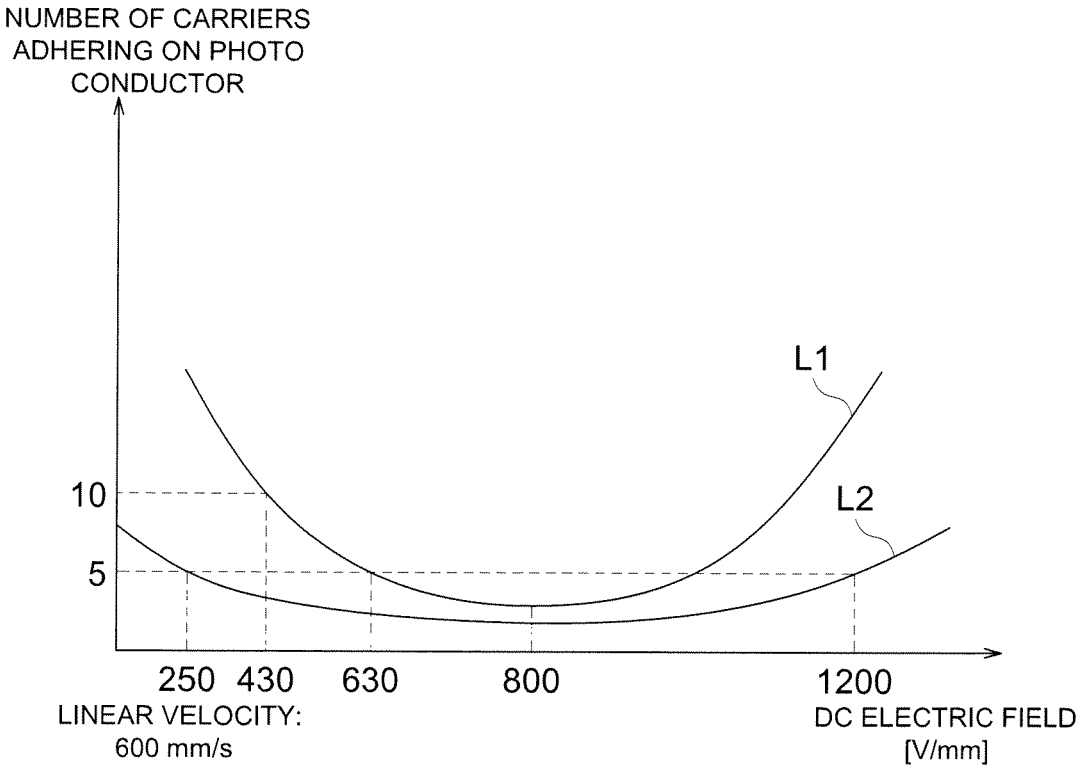
FIG. 10 is a diagram showing a relation between a change of an electric field created between a photoconductive member and an electrode and number of the carriers (hereinafter called adhering carrier number) remaining on the photoconductive member after removing the carriers on the photoconductive member as in embodiment 1.
Figure 11:
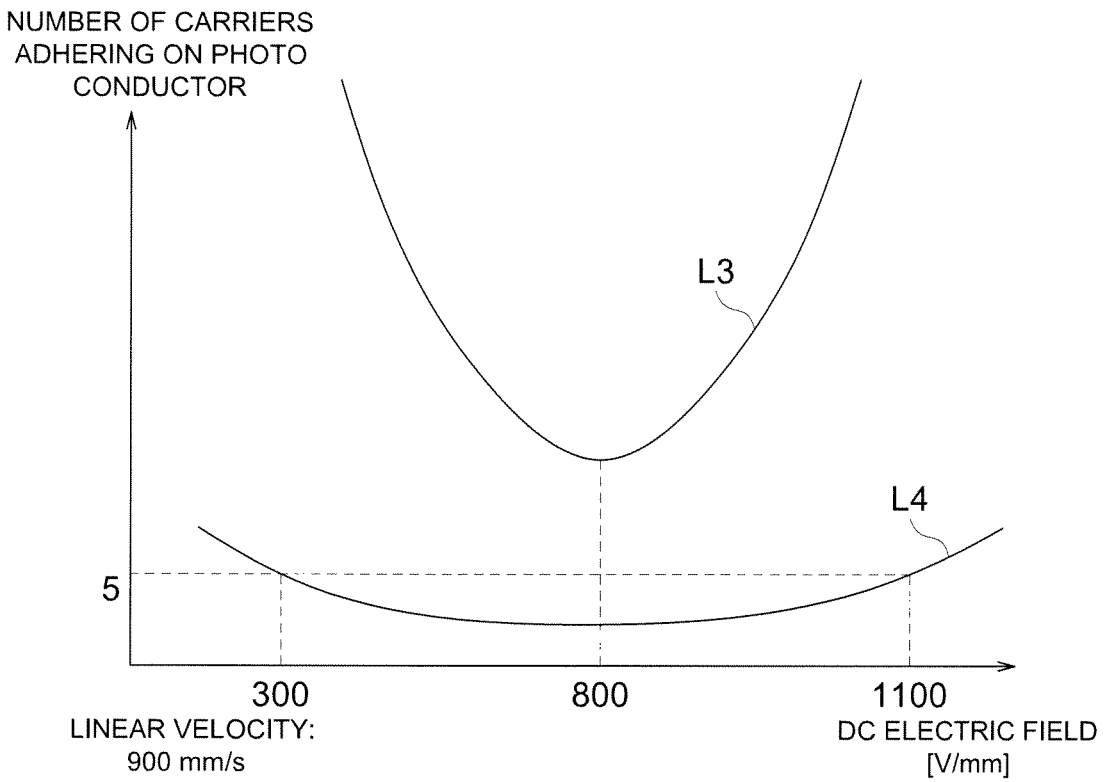
FIG. 11 is a diagram showing a relation between a change of an electric field created between a photoconductive member and an electrode and the adhering carrier number after removing the carriers on the photoconductive member as in embodiment 2.

As to the embodiments 1 and 2 and the comparison example, relations of changes of the electric field formed between the photoconductive member and the electrode with respect to the number of the carriers remaining on the photoconductive member after removing the carrier are shown in FIGS. 10 and 11. L1 and L3 show data of the comparison example and L2 and L4 show data of the embodiments 1 and 2.

FIGS. 10 and 11 indicate the following:

(4) The embodiments 1 and 2 exhibited extremely high carrier removing performance in a wide area of the electric field with respect to the comparison example. This means that in the embodiments 1 and 2, the high carrier removing performance is maintained even if the distance between the electrode and the photoconductive member changes, and a drastic increase of degree of freedom in designing the carrier removing apparatus is allowed.

(5) In the comparison example, when the linear speed (moving speed of the photoconductive member) is increased from 600 mm/s to 900 mm/s, the carrier removing performance is greatly decreased. However in the embodiments 1 and 2, almost no changes of the carrier removing performance occurred.

(6) In FIGS. 10 and 11, the embodiments 1 and 2, and the comparison example deteriorated the carrier removing performance under a low electric field and a high electric field. This is considered due to the following phenomenon.

Under the low electric field, since the force to separate the carrier form the photoconductive member is weak, the carrier removing performance is low. Under the high electric field, a chain formed by connecting the carriers adhering on the carrier recovering member such as the electrode is prolonged, then the end section of the chain at the photoconductive side is charged reversely (negative charge), and moves to the photoconductive side and adheres on the photoconductive member again. Namely, the carrier removing performance is deteriorated on the high electric field side as well.

In the present embodiment, the carrier is separated from the image carrier by applying the bias voltage onto the electrode having the plurality of the openings through which the carrier passes.

Therefore, the carrier separated from the image carrier does not adhere onto the image carrier again. Whereby, the carrier can be separated from the image carrier nicely.

What is claimed is:

1. A carrier removing apparatus, comprising:

an electrode disposed to oppose an image carrier on which a toner image is formed by a developing device using a two-component developer including carrier particles and toner particles based on image data, having a plurality of openings through which the carrier particles pass, and a power source to apply a voltage onto the electrode so as to separate the carrier particles on the image carrier from the image carrier, wherein the carrier particles on the image carrier are removed from the image carrier before a transfer member transfers the toner image formed on the image carrier by the developing device based on the image data onto a transfer material.

2. The carrier removing apparatus of claim 1, wherein the electrode is configured with a plurality of wires and the openings are intervals of the wires.

3. The carrier removing apparatus of claim 1, wherein the electrode is configured with a mesh and the openings are grid intervals of the mesh.

4. The carrier removing apparatus of claim 1, wherein the electrode has a surface along a surface of the image carrier.

5. The carrier removing apparatus of claim 1, wherein the image carrier is in a shape of a drum and the electrode is formed on a concentric circle with respect to a surface of the image carrier.

6. The carrier removing apparatus of claim 1, in the electrode is in a shape of a flat plate.

7. The carrier removing apparatus of claim 1, wherein the electrode is disposed between a magnet and the image carrier.

8. The carrier removing apparatus of claim 1, which is disposed under the image carrier, further comprising a container to store the carrier particles falling through the electrode.

9. The carrier removing apparatus of claim 1, further comprising a cleaning device to clean the electrode.

10. An image forming apparatus, comprising:

an image carrier to carry a toner image;

a developing device to develop a toner image on the image carrier using a two-component developer including carrier particles and toner particles based on image data, a carrier removing apparatus disposed at a downstream side of the developing device in a moving direction of the image carrier, and a transfer member to transfer the toner image onto a transfer material, wherein the carrier removing apparatus is provided with an electrode disposed to oppose the image carrier and having a plurality of openings through which the carrier particles pass, and a power source to apply a voltage onto the electrode so as to separate the carrier particles on the image carrier from the image carrier, and is disposed at a downstream side in the moving direction of the image carrier so that the carrier particles on the image carrier are removed from the image carrier before the transfer member transfers the toner image formed on the image carrier by the developing device based on the image data onto a transfer material.

11. The image forming apparatus of claim 10, wherein the carrier removing apparatus is disposed at a downstream side of the developing device and at an upstream side of a transfer section in a moving direction of the image carrier.

12. The image forming apparatus of claim 10, wherein the electrode is configured a plurality of wires and the openings are intervals of the wires.

13. The image forming apparatus of claim 10, wherein the electrode is configured with a mesh and the openings are grid intervals of the mesh.

14. The image forming apparatus of claim 10, wherein the electrode has a surface along a surface of the image carrier.

15. The image forming apparatus of claim 10, wherein the image carrier is in a shape of a drum and the electrode is formed on a concentric circle with respect to a surface of the image carrier.

16. The image forming apparatus of claim 10, wherein the electrode is in a shape of a flat plate.

17. The image forming apparatus of claim 10, wherein a magnet is disposed behind the electrode as seen from an image carrier side.

18. The age forming apparatus of claim 10, which is disposed under the image carrier, further comprising a container to store the carrier particles falling through the electrode.

19. The image forming apparatus of claim 10, further comprising a cleaning device to clean the electrode.

* * * * *